United States Patent [19]

Barrett

[11] 4,441,427

[45] Apr. 10, 1984

[54] LIQUID DESENSITIZED, ELECTRICALLY ACTIVATED DETONATOR ASSEMBLY RESISTANT TO ACTUATION BY RADIO-FREQUENCY AND ELECTROSTATIC ENERGIES

[75] Inventor: Joseph A. F. Barrett, Collegeville, Pa.

[73] Assignee: ICI Americas Inc., Wilmington, Del.

[21] Appl. No.: 353,321

[22] Filed: Mar. 1, 1982

[51] Int. Cl.[3] ..... F42B 3/18

[52] U.S. Cl. ..... 102/202.6; 102/202.1; 102/202.2; 102/204

[58] Field of Search ..... 102/202.6, 202.2, 202.1, 102/202.4, 202.5, 202.14, 204, 200, 322

[56] References Cited

U.S. PATENT DOCUMENTS

| | | | |
|---|---|---|---|
| 2,739,535 | 3/1956 | Rolland et al. | 102/202.6 |
| 2,759,417 | 8/1956 | O'Neill, Jr. | 102/202.6 |
| 2,891,477 | 6/1959 | Swanson | 102/202.6 |
| 3,372,640 | 3/1968 | Dow et al. | 102/202.6 |
| 3,572,247 | 3/1971 | Warshall | 102/202.2 |
| 3,978,791 | 9/1976 | Lemley et al. | 102/202.14 |
| 4,144,814 | 3/1979 | Day et al. | 102/202.14 |
| 4,291,623 | 9/1981 | Robinson et al. | 102/202.6 |
| 4,306,499 | 12/1981 | Holmes | 102/202.4 |
| 4,307,663 | 12/1981 | Stonestrom | 102/202.4 |
| 4,312,271 | 1/1982 | Day et al. | 102/202.14 |

*Primary Examiner*—Charles T. Jordan
*Attorney, Agent, or Firm*—Richard A. Rowe

[57] ABSTRACT

An improved electrically actuated detonator for use in oil well perforation guns is described wherein a hermetically sealed donor explosive propels a plate through a barrel cavity into a vented open space to initiate an acceptor explosive. If the open space fills with liquid the detonator fails to operate. The detonator is also resistant to actuation by radio-frequency and electrostatic energy.

6 Claims, 7 Drawing Figures

LIQUID DESENSITIZED, ELECTRICALLY ACTIVATED DETONATOR ASSEMBLY RESISTANT TO ACTUATION BY RADIO-FREQUENCY AND ELECTROSTATIC ENERGIES

This invention relates to improved electrically activated detonator devices and more particularly to detonator devices which fail to operate when immersed in liquid and which are able to withstand incidental high voltage static discharges, safely attenuate and dissipate radio frequency power by a factor of 25 decibels, and have substantial d.c. voltage protection when current is applied directly to the lead wires. In particular, the detonator devices are characterized by a controlled donor charge/acceptor charge booster arrangement separated by a ventilated open space. The detonator assembly also features elongated lead wires passing through a series of inductance plugs, a water impermeable resistor and initiator assembly, a vented open space, a water impermeable booster assembly and an open sleeve section for the insertion of a detonating fuse. The detonator device of this invention is particularly useful in the operation of perforation guns used for perforating oil well casings by use of lined shaped charges of high velocity detonating explosive.

In recent years a substantial number of oil wells have been drilled offshore atop rather cramped platforms located many miles out to sea. The equipment stored on these platforms is exposed to high concentrations of radio wave and electrostatic energy resulting from radio communication, radar, and lightening strikes. Therefore, any detonator stored on these platforms must be desensitized and reasonably guarded against preignition when exposed to these forces, and perform as desired when placed in the perforation gun and lowered into an oil well casing. However, because the casings to be perforated are frequently filled with water or oil or mixtures of water and oil means to prevent the gun from becoming filled with liquid must be provided. In some instances even though extensive precautions are taken to make perforation guns leak-proof a leak will occur filling the gun with liquid. In this case detonation will cause the gun to become jammed within the well casing after which it is extremely difficult and costly to remove. The assembly of this invention, therefore, provides for additional safeguards against firing a perforation gun when filled with liquid.

Liquid desensitized initiators have been described in U.S. Pat. Nos. 2,739,535, 2,759,417, 2,891,477, 3,212,439, 3,372,640, and 4,291,623. In some of these arrangements liquid penetrates the explosive and causes the detonator to fail. In other instances the donor charge is separated from the acceptor/booster charge by an open space which fills with liquid to desensitize the detonation. Detonators having ignition assemblies resistant to actuation by radio-frequency and electrostatic energy are described in U.S. Pat. Nos. 3,264,989 and 4,306,499 while detonators employing flying plate arrangements are described in U.S. Pat. No. 3,978,791.

These prior art arrangements are not completely acceptable for use in the industry because they fail in one way or another to meet the following requirements:

they do not function normally after exposure for 2–4 hours at temperatures of 425°–500° F., they do not deliberately fail in every instance when submersed in liquids and if not deliberately electrically activated do not function after liquid is removed, they do not withstand static discharges of at least 8000 volts from a 2500 picofarad capaciter in all possible modes of application, they do not have substantial d.c. voltage protection up to 40 volts applied directly to the lead wires, and they do not safely attenuate and disipate RF power by a factor of 25 decibels from 1 MHz through 4000 MHz.

Accordingly, an object of this invention is to provide a detonator device which meets in every way the above stated requirements. A further object is to provide an initiator assembly having an improved flying plate/-booster detonation arrangement which fails when submersed in liquid with a high degree of reliability. Additional objects are apparent in the description which follows.

These and other objects of the invention are accomplished by providing a detonator arrangement comprising a cylindrical outer sleeve wherein a centrally located donor explosive propels a plate having a critically controlled mass through a ventilated open space through a critical distance in open space to strike an acceptor explosive charge with a critical energy having a value less than that provided by the propelled plate at impact. Furthermore, the shock or pulse wave generated by the donor explosive when the open space is filled with liquid must be less than that required to generate a force through liquid which detonates the acceptor explosive. These critical factors can be controlled by restricting the size of the donor charge needed to accellerate a flying plate having a mass and diameter of fixed value. The donor, acceptor and booster charges can be sealed within a container to insure against deterioration by liquid contact and atmospheric moisture.

DRAWINGS

Figure 1:
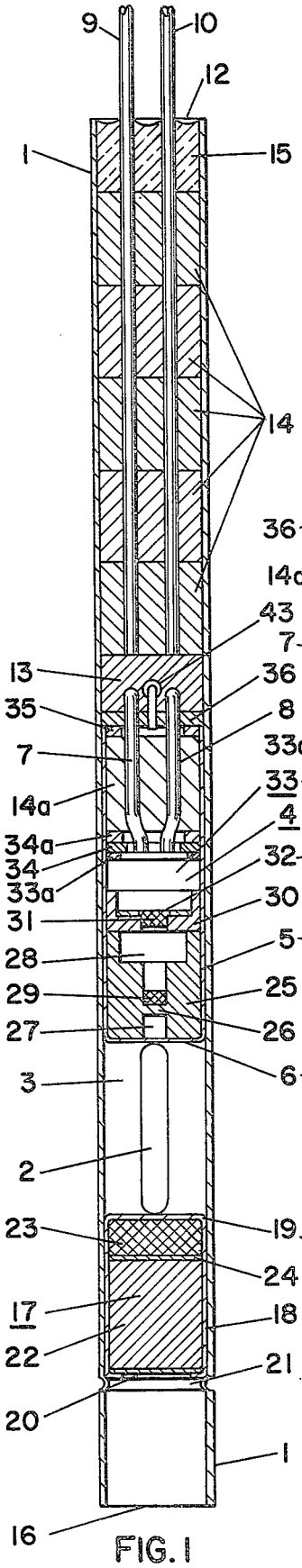
FIG. 1 is a longitudinal sectional view of an initiator assembly according to a preferred embodiment of this invention.
Figure 4:
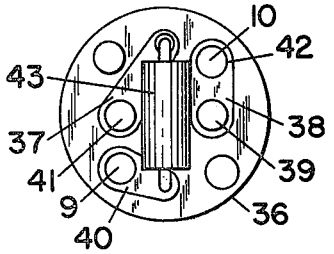
FIG. 4 is a plan view of the disc and resistor shown in FIG. 3.
Figure 3:
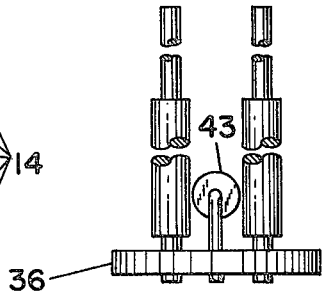
FIG. 3 is a cross sectional view of a printed circuit disc and resistor.
Figure 5:
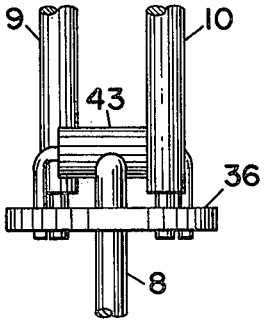
FIG. 5 is a rotated dimensional view of the disc and resistor shown in FIG. 3.
Figure 2:
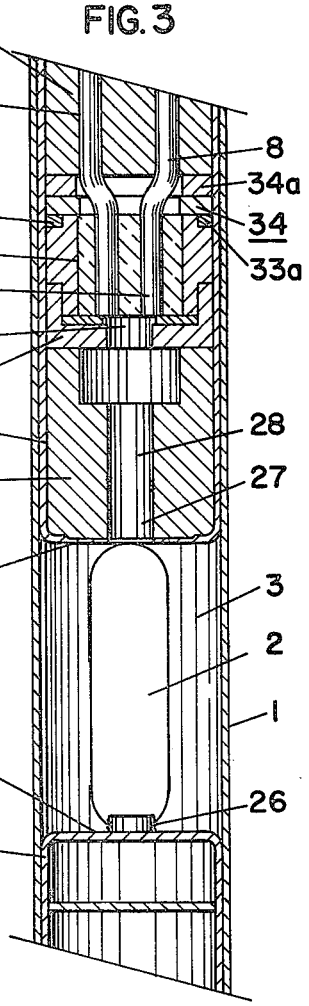
FIG. 2 is a larger scale longitudinal sectional view of a portion of the preferred initiator assembly of the invention after ignition.

The detonator device can be assembly in accordance with the following general description and obvious alternatives thereto and can be better understood by references to the drawings wherein a cylindrical tube or shell 1 having at least two opposed elongated openings 2 for ventilation of open space 3 is used to contain working components. Into shell 1 is placed an initiator assembly 4 which is contained in a deep drawn shell container 5 with bottom 6 wherein uncoated lead wires or pins 7 and 8 are connected to lead wires 9 and 10 through a resistor junction assembly comprising a copper clad circuit board fiber disc 36 before being pushed inside the assembly shell 1. The exterior diameter of the initiator assembly shell container 5 is such that it is a friction fit against the interior of assembly shell 1. In construction the initiator lead pins 7 and 8 are soldered to circuit board 36 and lead wires 9 and 10 outside of sleeve 1 and thereafter pushed down through the opening 12 of the assembly shell 1 to a point adjacent vent slots 2. The junction board 36 is coated with potting resin 13 to provide a seal which adheres to the interior of sleeve 1. The elongated inductance section is then installed by sliding five inductance rings 14 having 2 holes each in alignment with each other which are threaded over insulated lead wires 9 and 10 and pushed down through the sleeve in snug fit arrangement with the sleeve interior shell and sealed at opening 12 with a potting substance 15. Thereafter booster assembly 17 hermetically sealed in a deep drawn metallic container 18 having closed end 19 and sealed open end 20 is constructed such that the outside diameter of the shell 18 is sufficiently large to provide a friction fit with interior of shell 1 and is driven into the shell by force to a position up to vent slot 2. The booster assembly is then prevented from moving out through opening 16 by a crimp 21 placed circumferentially at its base in assembly shell sleeve 1.

The booster assembly 17 may contain an impact sensitive acceptor charge 23 and a booster charge 22 which are separated by an impenetrable membrane 24. The booster assembly may contain an impact insensitive one component charge. The acceptor and booster charges are compacted within shell 18 at pressures of about 7,000 to 15,000 pounds per square inch. Typical acceptor compositions include nitromannite, diazodinitrophenol, mercury fulmanate, lead azide and the like, but may also be of the same composition as the booster charge. Typical booster compositions include RDX, trinitrotoluene, pentaerithitoltetranitrate and preferably hexanitrostilbene. Explosives selected for the acceptor booster assembly can be picked such that the impact sensitivity has a critical energy value in a range of $1\times10^{-2}$ up to 30 calories per square centimeter. Such a range is well within the force exerted by the flying plate through air but must be higher than the shock wave energy imparted by the donor through liquids such as oil, water and mixtures thereof.

The initiator assembly 4 is preassembled by forcing a ferrule assembly 25 into the base of the metallic shell or casing 5. The ferrule can be constructed by drilling out from each end on the center line of a metal bar such as aluminum a cylindrically shaped hole to form a barrel cavity 27 and donor charge cavity 28 leaving a ledge 26 having a specific thickness and width which forms a flying plate when sheared and dislodged by donor explosive 29 which is pressed into the base of cavity 28 in carefully controlled amounts and shapes such that the ledge is driven in its original planar configuration through container bottom 6 into the open space 2 with sufficient force to detonate acceptor explosive 23. Above the ferrule 25 is positioned an igniter cup 30 holding ignition charge 31 in contact with a bridge wire 32 having connection with lead pins 7 and 8 which pass through a glass plug-to-metal sleeve seal 33 soldered at **33*a* to casing 5 to form a circumferencial impervious seal. A static discharge disc 34 shown in detail in FIGS. 6 and 7 and spacer ring 34*a* is inserted. Lead pins 7 and 8 further pass through a first inductance sleeve 14*a* held in the igniter assembly by a friction disc 35. The wire pins then pass through a fiber circuit board 36 at holes 41 and 39. The pins are soldered to printed copper clads 37 and 38. Lead wire 9 is soldered to copper clad 40 on the circuit board and connects with a 51 ohm resistor 43 soldered to copper clads 37 and 40. Lead wire 10 is soldered to copper clad at 42 which connects with lead pin 8 through copper clad 38 circuitry. Lead wires 9 and 10** are usually coated with a suitable plastic material such as polytetrafluoroethylene. Similar igniter assemblies are further described in my copending application U.S. Ser. No. 96,080 filed Nov. 20, 1979.

Figure 7:
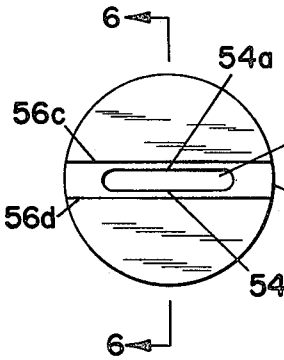
FIG. 7 is a plan view of a static discharge disc employed in the assembly of FIG. 1 and FIG. 2.
Figure 6:
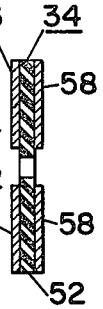
FIG. 6 is a sectional view of the static discharge disc shown in FIG. 7 taken along line 6—6.

In reference to FIGS. 6 and 7 static discharge disc 34 is more completely described in U.S. Pat. No. 4,307,663 to Stonestrom. The preferred static discharge disc 34 is made of copper clad phenolic printed circuit board material. Other rigid nonconducting substrate materials can also be employed. The substrate 52 includes an opening slot 54 of oblong shape, having opposed parallel sides **54*a* and 54*b*. The slot 54 is preferably centered so that the parallel sides 54*a*, 54*b* lie approximately equal distance from a diameter of disc 34. The width of the slotted opening 54 (that is the distance between parallel sides 54*a* and 54*b*) is slightly greater than the diameters of lead pins 7 and 8. Portions of both phases of substrate 52 are coated with electrically conductive layers 56 and 58 preferably of copper. Layers 56 and 58 are identical. To avoid short circuiting in the event either lead wire touches either edge 54*a* or 54*b* of the slotted opening 54 it is important that the inner boundaries 56*c* and 56*d* of the conductive portions do not contact any portion of the edge opening 54. The same is true on the reverse side for conductors 58**.

As inductance material employed for the inductance ring sections 14 and **14*a*** may be employed any magnetic material exhibiting permeability and may be in the form of a solid plug or a multiturn coil. Preferably it will have an inductance such that the power induced by radio-frequency energy in the lead wires is reduced by a factor of at least 25 dB and preferably 40–60 dB. Good examples of such material are the ferrites which are usually spinels containing an oxide of iron in combination with some other metal oxide or combination of oxides for example $MFe_2O_4$ wherein M is divalent manganese, iron, cobalt, nickel, copper, magnesium or zinc. A preferred ferrite is composed of manganese oxide, zinc oxide and ferric oxide. The rings or beads must surround and either contact or be closely adjacent to the conductors. The inductance plug section may be designed so that the elongated lead wire conductors can be passed there through once or several times.

The resistor 43 which is connected in series with lead wire 9 and 7 may be any material having a resistance of about 50 ohms such that an electrical voltage of 50 volts is required to fire the detonator when placed across leads 9 and 10.

The initiator is designed to be used in combination with detonation fuse material (not shown) which is inserted through the open end 16 adjacent to booster section 22 and which connects with a series of shaped charges held within a perforation gun (not shown). The inside diameter of the open end or means for holding the detonation fuse is usually adjusted such that a snug fit is formed with the inserted fuse. Example of this type fuse is sold under the trademark PRIMACORD ®.

The operation of the device of the present invention is as follows:

When a firing current of at least 0.8 amps is applied to lead wires 9 and 10 current passes through circuit junction disc 36 passes through lead wires 7 and 8 heating wire bridge 32 sensitizing ignition charge 31 which in turn initiates donor charge 29 thereby shearing plate 26 which is propelled through barrel section 27. The plate penetrates through bottom section 6 of initiator container shell 5 through the core of open space 3 venting gas through slots 2 such that the flying plate strikes booster assembly 19 at the center point with sufficient force to initiate acceptor charge 23 which in turn initiates booster charge 22 which is propagated through a detonator fuse (not shown) inserted in opening 16. However, if the device is immersed in liquid which passes through slot openings 2 filling open space segment 3 with liquid the force of flying plate 26 will be diminished sufficiently below the energy of activation of the acceptor charge 23 when and if it strikes. The force executed will be insufficient to detonate the acceptor either by a direct hit by the flying plate or by the shock wave transmitted through the liquid.

The overall dimensions of the initiator device is usually dictated by the size of the perforation gun and its design. In most cases the overall length ranges from 8–15 cm with an outside diameter of 6–8 mm. The internal dimension are controlled by materials of construction and their strength as is well recognized by those skilled in the art.

Of critical concern to the invention is the relationship between the donor charge, its size and shape, its positioning with respect to the plate, the mass of the plate and the distance traveled by the plate to the acceptor charge. Of further concern is the length of the barrel cavity 27, thickness of shell container 6, the length of open space 3 from 6 to 19 and the width and length of opposing vent slots 2.

For example, if one starts with a ferrule design which produces a sheared plate of 2 mm in diameter with a thickness of 0.5 mm critical distances and charges can be calculated using the following conventional relationships:

$$\text{Energy of Flyer Plate} = AtP^2/QV_s$$

where A=Plate Area, t=pulse width, P=Hugoneot Pressure of Donor explosive, Q=plate density and $V_s$=shock velosity of donor explosive.

Energy Required to Initiate Acceptor Explosive=$P^2t$ where P=pressure in kilobars, and t=pulse width in micro seconds.

$$\text{Energy/Unit Area} = P^2t/Z_A$$

where $Z_A$ is a function of density and shock velocity of the acceptor explosive. Energy transferred must be substantially greater than the iniation energy.

In the case where the plate 26 is aluminum, the distance between the plate and the acceptor charge is 15 mm, a donor charge 29 of 10±0.5 milligrams of lead azide compacted in the donor cavity against the ledge 26 at 103,400±3500 KPA is required to initiate a lead azide acceptor 23. Furthermore, the donor charge is compacted and shaped such that the plate remains in its undistorted and unchanged planar configuration until it strikes the acceptor charge which is critical to the invention. This is important because energy requirements change if the plate tumbles or bends out of shape or is reduced to particles and the reliability of the device becomes unpredictable especially in liquid. Usually the donor charge cavity directly above the plate has a width nearly identical to the diameter of the plate.

To insure that the plate remains in the core of the device and strikes the center of the acceptor charge assembly in a flat planar configuration the length of travel through the barrel cavity 27 should be at least equivalent to the width of the plate and preferably slightly longer.

The thickness of the initiator container bottom 6 should be thick enough to form an impermeable barrier and thin enough such that it will not impede the travel of the plate as it leaves the barrel. In deep drawn shaping it is usually reduced to less than half the thickness of the shell wall.

The open space distance from initiator bottom 6 to acceptor 19 is adjusted from 6 to 13 mm and depends upon mass of the plate, and the particular donor charge and acceptor charge used. In the above case the distance is 12.5 mm. Preferably with less sensitive acceptor explosives the distance can be reduced. Suitable distances are best determined to match the plate mass, donor charge and acceptor charge when fired in air and liquid.

At least two opposing elongated vent openings are preferred which extend from one end of the open space to the other to allow liquid to enter and completely fill the open space without the entrapment of gas/air bubbles or to permit the liquid to completely drain when withdrawn from liquid. If three or more openings are employed they may be spaced evenly about the circumference. This requirement is critical to desensitizing the initiator because the entrapment of gas pockets may permit the flying plate to strike the acceptor with sufficient energy to cause its activation. In most instances an opening width of 1–6 mm preferably 3.5 mm is sufficient.

What is claimed is:

1. An electrically activated detonator assembly for use in perforation guns which fails to detonate when immersed in liquids which comprises an elongated cylindrical outer sleeve having centrally located therein a hermetically sealed donor explosive initiator means held within a first container to propel a sheared plate in its original planar configuration through said first container longitudinally within the bore of said sleeve to strike an acceptor explosive hermetically sealed within a second container fixed at a point within said sleeve and separated from said initiator means by an open space, said outer sleeve having at least two opposing elongated vent openings located adjacent said open space having a length and a width wherein said length is at least equivalent to the distance separating said first container from said second container to provide a continuous opening in the outer sleeve between said containers, the width of said vent openings being sufficient to admit passage of liquid into and completely fill said open space when fully immersed in liquid, whereby when said assembly is electrically activated and said open space is filled with liquid neither the force of the plate striking said acceptor explosive nor the shock wave created therein is sufficient to detonate said acceptor explosive.

2. A detonator assembly of claim 1 protected against actuation by radio-frequency energy in the range of 1 MHz through 4000 MHz comprising elongated lead wires passing through inductance means positioned within said outer sleeve to dissipate said energy by a factor of at least 25 decibels.

3. A detonator assembly of claim 1 protected against actuation by electrostatic energy comprising lead wire means wherein one wire is connected in series with a 50 ohm resistor such that a 50 volt power source applied across the said lead wire means is required to activate the detonator.

4. A detonator assembly of claim 1 wherein said plate is sheared from a cylindrical ferrule having an elongated barrel cavity held within said first container whereby said plate travels through said cavity before passing through said first container.

5. An initiator assembly of claim 4 wherein said plate travels through said barrel cavity for a distance at least equivalent to the width of said plate.

6. A detonator assembly of claim 1 further comprising a means for holding a detonation fuse adjacent said second container.

* * * * *